US007540799B1

(12) United States Patent
Trojan

(10) Patent No.: US 7,540,799 B1
(45) Date of Patent: Jun. 2, 2009

(54) SYSTEM FOR ADJUSTING AN END EFFECTOR RELATIVE TO A WORKPIECE

(76) Inventor: Daniel R. Trojan, 2534 E. Amberwood Dr., Phoenix, AZ (US) 85048

( * ) Notice: Subject to any disclaimer, the term of this patent is extended or adjusted under 35 U.S.C. 154(b) by 37 days.

(21) Appl. No.: 11/678,717

(22) Filed: Feb. 26, 2007

(51) Int. Cl.
*B24B 49/00* (2006.01)

(52) U.S. Cl. ..... 451/8; 451/443

(58) Field of Classification Search ..... None
See application file for complete search history.

(56) References Cited

U.S. PATENT DOCUMENTS

| | | | | |
|---|---|---|---|---|
| 2,234,539 | A * | 3/1941 | Cooke | 125/11.08 |
| 2,366,790 | A * | 1/1945 | Horton | 137/636 |
| 2,569,291 | A * | 9/1951 | Davis | 451/280 |
| 5,367,866 | A * | 11/1994 | Phillips | 451/307 |
| 5,433,656 | A * | 7/1995 | Cloutier et al. | 451/156 |
| 5,885,147 | A | 3/1999 | Kreager et al. | |
| 6,500,055 | B1 | 12/2002 | Adams et al. | |
| 6,508,697 | B1 | 1/2003 | Brenner et al. | |
| 6,620,030 | B1 * | 9/2003 | Delmoro et al. | 451/11 |
| 6,695,680 | B2 * | 2/2004 | Choi et al. | 451/5 |
| 6,769,968 | B2 | 8/2004 | So | |
| 6,945,856 | B2 * | 9/2005 | Boyd et al. | 451/56 |
| 2002/0170130 | A1 * | 11/2002 | Shinler | 15/49.1 |
| 2003/0114091 | A1 * | 6/2003 | Immordino et al. | 451/353 |
| 2006/0196299 | A1 * | 9/2006 | Taboada et al. | 74/490.01 |
| 2008/0009231 | A1 * | 1/2008 | Stinson et al. | 451/443 |

OTHER PUBLICATIONS

Dyer and Schlueter, "Characterizing CMP Pad Conditioning Using Diamond Abrasives," Wet Surface Technology, Micromagazine.com, MICRO, Jan. 2002.

* cited by examiner

*Primary Examiner*—Maurina Rachuba
(74) *Attorney, Agent, or Firm*—Lowell W. Gresham; Jordan M. Meschkow; Gouri G. Nair

(57) ABSTRACT

A system (46) for adjusting an end effector (48) of an apparatus (44) includes a linear actuator (58) attachable with an arm (52) of the apparatus (44). The system (46) further includes a first link member (64) having a first segment (68) operatively coupled with the linear actuator (58), and a second link member (66) maintained in parallel alignment with a second segment (70) of the first link member (64). The first and second link members (64, 66) pivotally attach to the end effector (48), and movement of the first segment (68) powered by the actuator (58) causes the first and second link members (64, 66) to pivot producing movement of the end effector (48) relative to a workpiece (26). A force transducer (76) interposed between the actuator (58) and the first link member (64) is utilized to control a pressure of the end effector (48) against the workpiece (26).

17 Claims, 5 Drawing Sheets

20

SYSTEM FOR ADJUSTING AN END EFFECTOR RELATIVE TO A WORKPIECE

TECHNICAL FIELD OF THE INVENTION

The present invention relates to the field of chemical-mechanical polishing (CMP). More specifically, the present invention relates to a system for adjusting an end effector used to condition a polishing pad of a CMP apparatus.

BACKGROUND OF THE INVENTION

Semiconductor wafers, sometimes called silicon wafers, are commonly used as a base on which multilevel integrated circuits are fabricated. A series of deposition and etch steps are required to form such a multilevel pattern on a semiconductor wafer. The deposition and etch steps are typically performed utilizing photolithographic optics-based processes. These processes require accurate focusing in order to produce a precise image on the semiconductor wafer. To achieve accurate focusing, wafers for the semiconductor industry must possess a high degree of surface perfection. Indeed, a non-planar semiconductor wafer surface can result in lower yield and decreased performance of the semiconductor devices, due to inaccurate focusing adversely affecting the photolithographic processes. Accordingly, surface planarity of the wafer is a critical issue in the semiconductor industry.

Chemical-mechanical polishing (CMP) is commonly used for polishing or "planarizing" the front face of a semiconductor wafer. A CMP process may be used to remove rough spots and irregularities from the wafer and to produce a planar surface and substantially uniform thickness of the wafer.

The process steps (using lithography, deposition, and etching) performed to create each layer of the multilevel integrated circuit can result in a multiplicity of irregularities on the wafer surface. It is crucial that these irregularities be removed so that processing can continue to develop new layers or circuitry without loss of focus in the lithography and so that accurate interconnections can be formed between the layers. Accordingly, in addition to polishing the wafer surface, CMP may be employed to planarize the topography of the interconnect layers of the electrical circuitry above the wafer surface.

FIG. 1 shows a diagram of an exemplary prior art CMP apparatus 20 for polishing a semiconductor wafer 22. In general, exemplary CMP apparatus 20 includes a platen 24 upon which a polishing pad 26 is mounted. Semiconductor wafer 22 may be mounted in a wafer carrier (not shown) with the integrated circuit side facing toward polishing pad 26. To planarize wafer 22, polishing pad 26 is brought into contact with semiconductor wafer 22. While wafer 22 presses against polishing pad 26, at least one of platen 24 and the wafer carrier moves relative to the other to move wafer 22 across polishing pad 26. As wafer 22 moves across polishing pad 26, material is continuously removed from wafer 22. Polishing pad 26 may be pre-soaked and may be continually re-wet with a slurry that has a variety of abrasive particles suspended in a solution.

One problem with CMP processing is that the slurry and abraded materials tend to glaze the surface of polishing pad 26. This accumulation of debris reduces the surface roughness and adversely affects polishing rate and uniformity. To counter this problem, CMP apparatus 20 includes a conditioning apparatus 28 for "conditioning" polishing pad 26. In particular, conditioning apparatus 28 is utilized to roughen the surface of the polishing pad 26.

Conditioning apparatus 28 includes a conditioning arm 30 with an end effector 32 that includes an abrasive disk (not visible). A drive mechanism 34 is coupled at an opposite end of conditioning arm 30 from end effector 32. Drive mechanism 34 is in communication with end effector 32 to cause rotational movement 36 of end effector 32. In addition, conditioning apparatus 28 includes means for vertical movement 38 of end effector 32 to bring end effector 32 into contact with polishing pad 26. Conditioning arm 30 may also include means for rotational movement 40 about axis B, so that end effector 32 is allowed to sweep in a radial direction across a predetermined portion of polishing pad 26. System control may be via a controller 42 which receives conditioning parameters to control rotational movement 36, vertical movement 38, and rotational movement 40 about axis B.

Recent improvements in conditioning apparatuses entail the inclusion of a gimbal mechanism interfaced with end effector 32 so that the abrasive disk of end effector 32 remains level, thus parallel to polishing pad 26. The object of such a mechanism is to yield more uniform, thus efficacious, conditioning of polishing pad 26.

There are a number of problems associated with conventional conditioning apparatuses, such as conditioning apparatus 28. For example, the conditioning pressure of end effector 32 against polishing pad 26 may differ from that which is desired leading to undesirably slow and inefficient conditioning, or conversely, leading to excessive or non-uniform, conditioning that ultimately damages polishing pad 26.

The introduction of vertical movement 38 in some prior art devices can yield undesirably high internal friction. Accordingly, the force developed by the mechanism producing vertical movement 38 and applied to the surface area of end effector 32 may be "absorbed" by the high internal friction of the mechanism, and is thus not transmitted to end effector 32. This friction can contribute to significant error, in terms of an effective reduction in the actual conditioning pressure applied by end effector against polishing pad 26. Consequently, high friction contributes to imprecision in controlling the amount of conditioning pressure applied by end effector 32 against polishing pad 26. If the conditioning pressure is too low, the rate of conditioning of polishing pad 26 may be undesirably slow and inefficient.

In addition, the conditioning pressure of end effector 32 against polishing pad 26 is not currently measured in prior art systems. Thus, it is difficult to compensate or account for the absorption of force due to internal friction. Even if the absorption of force by friction is somehow compensated for, the conditioning pressure can change over time due to mechanical wear of internal components within end effector 32. Mechanical wear can cause a change to internal friction in the mechanism producing vertical movement 38, further introducing an error component to the conditioning pressure.

Typical conditioning apparatuses do not include position feedback of end effector 32 relative to the polishing pad 26. Accordingly, if there is a mechanical failure of components within end effector 32 that causes the distance between end effector 32 and polishing pad 26 to differ from what is expected, this difference may go undetected. Such a situation is undesirable because the polishing pad 26 may become damaged during the conditioning process, the rate of conditioning may be undesirably slow, or conditioning may not occur at all. Unfortunately, such a scenario cannot be detected without interfering with the conditioning process and/or incurring excessive and costly down time.

Yet another problem with prior conditioning apparatuses is that the force range of the mechanism producing vertical movement 38 is limited by the amount of pressure that can be exerted on the internal mechanisms of end effector 32. An undesirable limitation of the force further leads to undesirably slow and inefficient conditioning.

SUMMARY OF THE INVENTION

Accordingly, it is an advantage of the present invention that a system for adjusting an end effector of an apparatus relative to a workpiece is provided.

It is another advantage of the present invention that a system is provided in which the conditioning pressure of the end effector can be precisely controlled while maintaining parallel orientation between the end effector and the plane of the workpiece Another advantage of the present invention is that a system is provided for adjusting the end effector that includes capability for measurement of the applied force of the end effector.

Another advantage of the present invention is that a system is provided for adjusting the end effector that includes capability for detecting the position of the end effector.

Yet another advantage of the present invention is that a system is provided for adjusting the end effector while minimizing vertical height of the system.

The above and other advantages of the present invention are carried out in one form by a system for adjusting an end effector of an apparatus relative to a workpiece. The system includes a linear actuator configured for fixed attachment with an arm of the apparatus. A first link member includes a first segment and a second segment adjoined with the first segment, the first segment being operatively coupled with the linear actuator. A second link member is maintained in parallel alignment with the second segment. The second segment and the second link member are configured for pivotal attachment with the end effector, wherein movement of the first segment powered by the linear actuator causes the first and second link members to pivot producing movement of the end effector relative to the workpiece.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

The present invention is a system for precisely adjusting an end effector of an apparatus relative to a workpiece. More specifically, the present invention is configured for interconnection with a conditioning apparatus for conditioning polishing pads such as those used in Chemical Mechanical Polishing or Planarization (CMP) Systems. The system is advantageously utilized to precisely adjust an end effector of the conditioning apparatus relative to the polishing pad. The specific details of the preferred embodiment provide a thorough understanding of the invention. However, some CMP system and conditioning apparatus elements which operate in conjunction with the present invention have not been described in detail in order to avoid unnecessarily obscuring the present invention.

Figure 1:
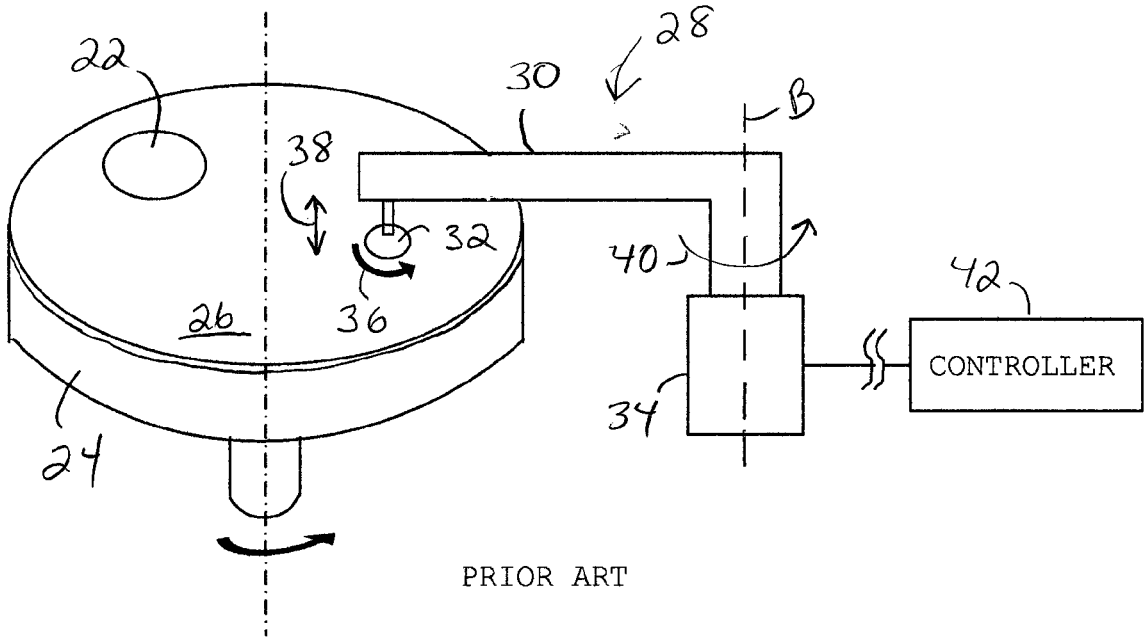
FIG. 1 shows a diagram of an exemplary prior art chemical mechanical planarization (CMP) apparatus for polishing a semiconductor wafer.
Figure 2:
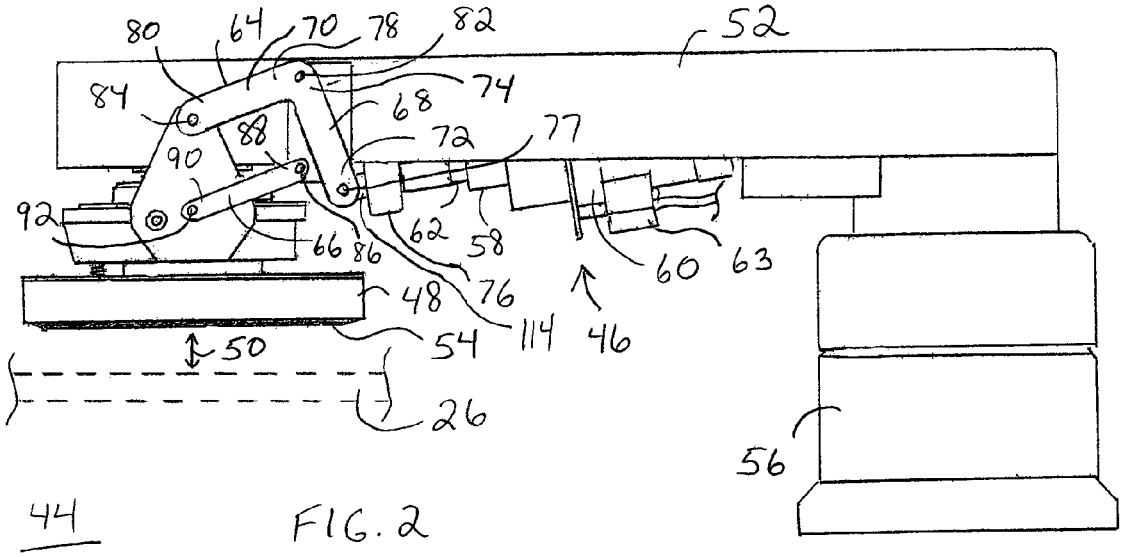
FIG. 2 shows a side view of a conditioning apparatus that includes an adjustment system for adjusting an end effector in accordance with a preferred embodiment of the present invention.

FIG. 2 shows a side view of a conditioning apparatus 44 that includes an adjustment system 46 for adjusting an end effector 48 of apparatus 44 in accordance with a preferred embodiment of the present invention. System 46 advantageously enables vertical movement 50 of end effector 48 to bring end effector 48 into contact with a workpiece, such as polishing pad 26 (shown in ghost form). Although the present invention is described in connection with a rotary driven polishing pad 26, it should be understood that adjustment system 46 is interconnectable with the conditioning apparatus, such as conditioning apparatus 44. As such, the present invention need not be limited to a particular CMP system, but may be adapted for use with a variety of CMP systems, such as other rotary systems, orbital systems, oscillatory systems, and/or belt-type systems. Moreover, the system of the present invention need not be limited for use with conditioning apparatuses, but may additionally be adapted in other systems to precisely adjust a load relative to a workpiece.

Conditioning apparatus 44 generally includes a conditioning arm 52 having end effector 48 positioned at one end of arm 52. End effector 48 includes an abrasive disk 54. Abrasive disk 54 may include diamond abrasive conditioners, cutting teeth, brushes, and the like known to those skilled in the art. A drive mechanism 56 is coupled at an opposite end of conditioning arm 52. Drive mechanism 56 is in communication with end effector 48 to cause rotational movement of end effector 48 and/or to allow end effector 48 to sweep in a radial direction across a predetermined portion of polishing pad 26.

Conditioning apparatus 44 may include a gimbal mechanism interfaced with end effector 48 so that abrasive disk 54 remains level, thus parallel to the plane of polishing pad 26. Adjustment system 46 is adapted to enable precise vertical movement 50 of end effector 48 in the presence or absence of this feature.

Adjustment system 46 includes a linear actuator 58 configured for fixed attachment with conditioning arm 52. More specifically, a body 60 of linear actuator 58 is coupled to an underside of conditioning arm 52 (best seen in FIG. 7). In a preferred embodiment, linear actuator is a double-acting pneumatic air cylinder driven by pressure differential in the cylinder chambers. The double-acting feature enables both sides of a piston flange (not shown) to be alternately pressurized for bi-directional powered motion of a drive element 62 extensible from body 60. Alternatively, one side of the piston flange may be pressurized to provide force and motion to drive element 62 with a spring providing return force after pressure is released. Adjustment system 46 may further include a position sensor 63 for determining a position of end effector 48 relative to polishing pad 26. Position sensor 63 will be discussed in greater detail in connection with FIGS. 4-5.

In an exemplary embodiment, drive element 62 is an elongated rod having a generally circular cross-sectional configuration. However, it should be understood that drive element 62 may alternatively be an elongated member extensible from body 60 having any of a number of cross-sectional configurations. Moreover, although a double-acting pneumatic air cylinder is described herein for use as linear actuator 58, it should be understood that a variety of types of linear motion devices may alternatively be utilized. Such linear motion devices include, for example, those powered by hydraulics, pneumatics, or electric motors, and configured to be rod or rodless.

Adjustment system 46 further includes a first link member 64 and a second link member 66. First link member 64 includes a first segment 68 and a second segment 70. First segment 68 includes a first end 72 and a second end 74, and first segment 68 is operatively coupled with drive element 62 via a force transducer 76. In particular, first end 72 of first segment 68 includes an actuator pivot point 77 that enables pivotal movement of first segment 68 relative to force transducer 76 and linear actuator 58. Second segment 70 includes a third end 78 and a fourth end 80, with third end 78 being adjoined with second end 74 of first segment 68. In a preferred embodiment, second segment 70 is fixedly arranged approximately perpendicular to first segment 68. As such, first link member 64 is a generally L-shaped element.

First link member 64 includes a first pivot point 82, positioned at the junction of first and second segments 68 and 70, respectively, and configured for pivotal attachment to conditioning arm 52. In addition, fourth end 80 of first link member 64 at second segment 70 is pivotally attached to end effector 48 at a first effector pivot point 84. Likewise, second link member 66 includes a second pivot point 86, positioned at a first end 88, and pivotally attached to conditioning arm 52. A second end 90 of second link member 66 is pivotally attached to end effector 48 at a second effector pivot point 92.

A distance between first and second pivot points 82 and 86, respectively, is equivalent to a distance between first and second effector pivot points 84 and 92, respectively. In addition, a distance between first pivot point 82 and first effector pivot point 84 is equivalent to a distance between second pivot point 86 and second effector pivot point 92. Furthermore, second pivot point 86 is vertically aligned with first pivot point 82 on conditioning arm 52, and second effector pivot point 92 is vertically aligned with first effector pivot point 84 on end effector 48. Consequently, through the various pivotal attachment points and locations described above, second link member 66 is maintained in parallel alignment with second segment 70 of first link member 64.

Figure 3:
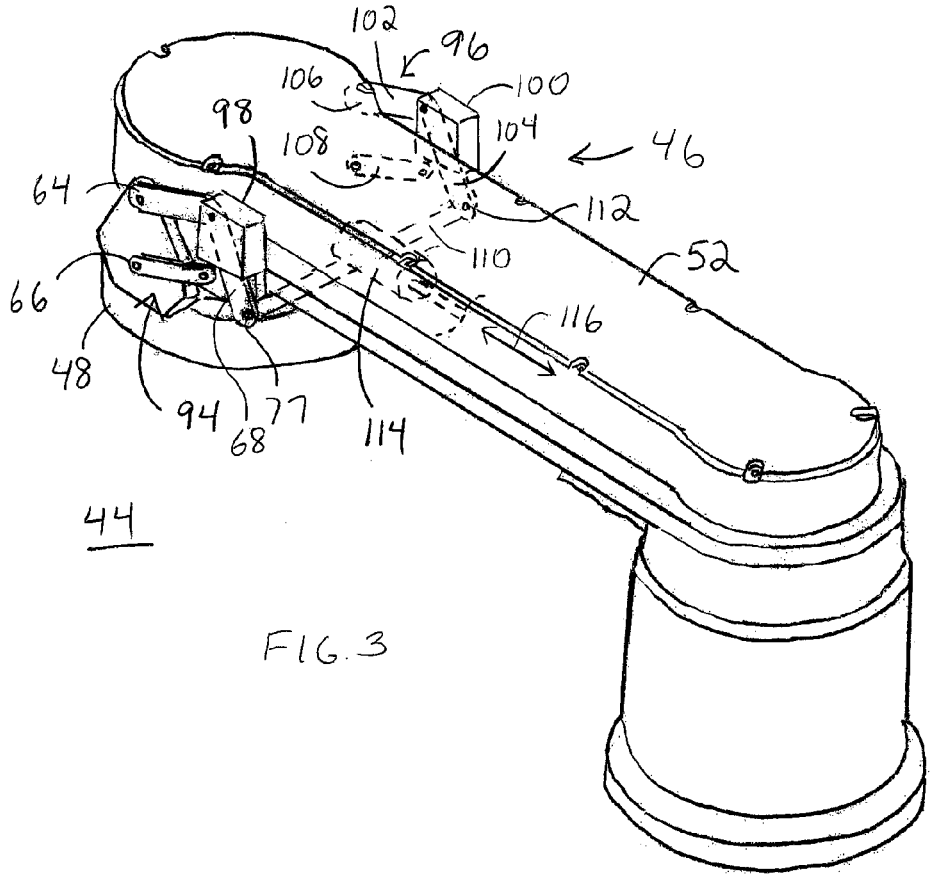
FIG. 3 shows a perspective top view of the conditioning apparatus of FIG. 2.

FIG. 3 shows a perspective top view of conditioning apparatus 44. First and second link members 64 and 66, respectively form a first parallel linkage assembly 94 of adjustment system 46. However, system 46 further includes a second parallel linkage assembly 96 positioned on a diametrically opposing side of end effector 48 relative to first linkage assembly 94. A first housing 98 shields and protects a portion of first linkage assembly 94. Similarly, a second housing 100 shields and protects a portion of second linkage assembly 96.

The components of second linkage assembly 96 correspond to those of first linkage assembly 94. That is, second linkage assembly 96 includes a third link member 102 having a third segment 104 and a fourth segment 106 (portions of which are shown in ghost form). Second linkage assembly 96 further includes a fourth link member 108 (shown in ghost form) maintained in parallel alignment with fourth segment 106. Third and fourth link members 102 and 108, respectively, pivotally couple to each of conditioning arm 52 and end effector 48 in a similar manner to first and second link members 64 and 66, respectively. Accordingly, the discussion need not be repeated.

In addition, third link member 102 pivotally couples to force transducer 76 (FIG. 2) in a similar manner to first link member 64. Although shown in ghost form, an axle 110 may be pivotally coupled to each of actuator pivot point 77 and a second actuator pivot point 112 of second linkage assembly 96. In addition, axle 110 may be fixedly coupled to a fixture 114 that is, in turn, coupled to force transducer 76. A linear force 116 generated by linear actuator 58 (FIG. 2) and transferred through force transducer 76 pushes, or alternatively pulls, axle 110, and results in pivotal movement of corresponding first and third segments 68 and 104, respectively (discussed in detail below).

Figure 4:
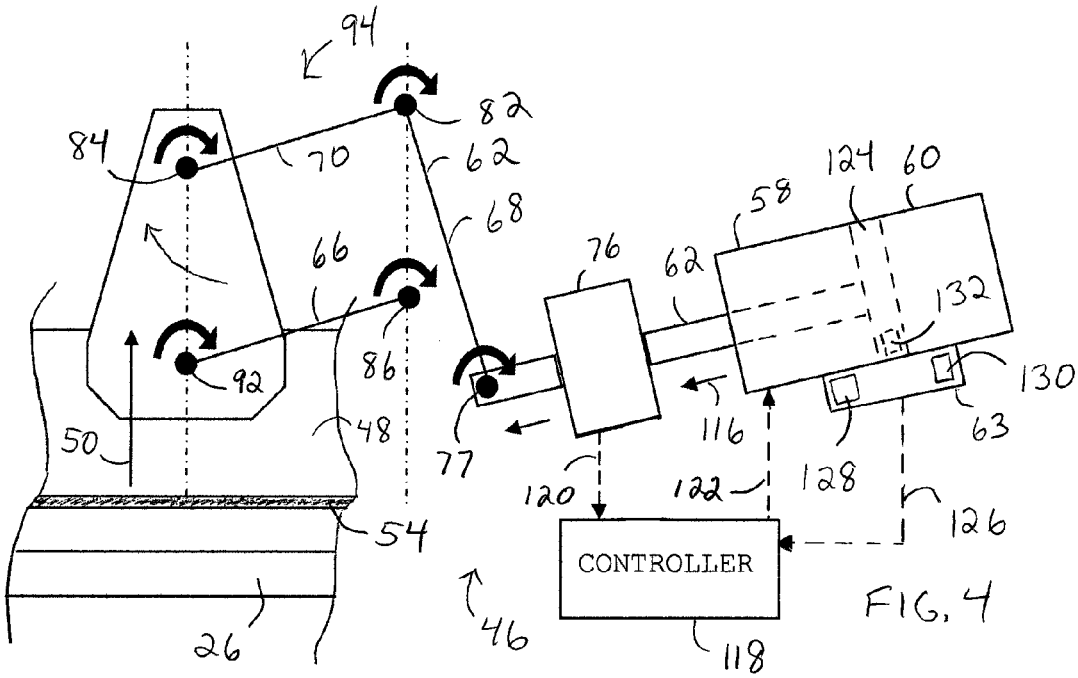
FIG. 4 shows a block diagram of the adjustment system of FIG. 2 exemplifying an upward vertical movement of an end effector in response to actuation of a linear actuator.
Figure 5:
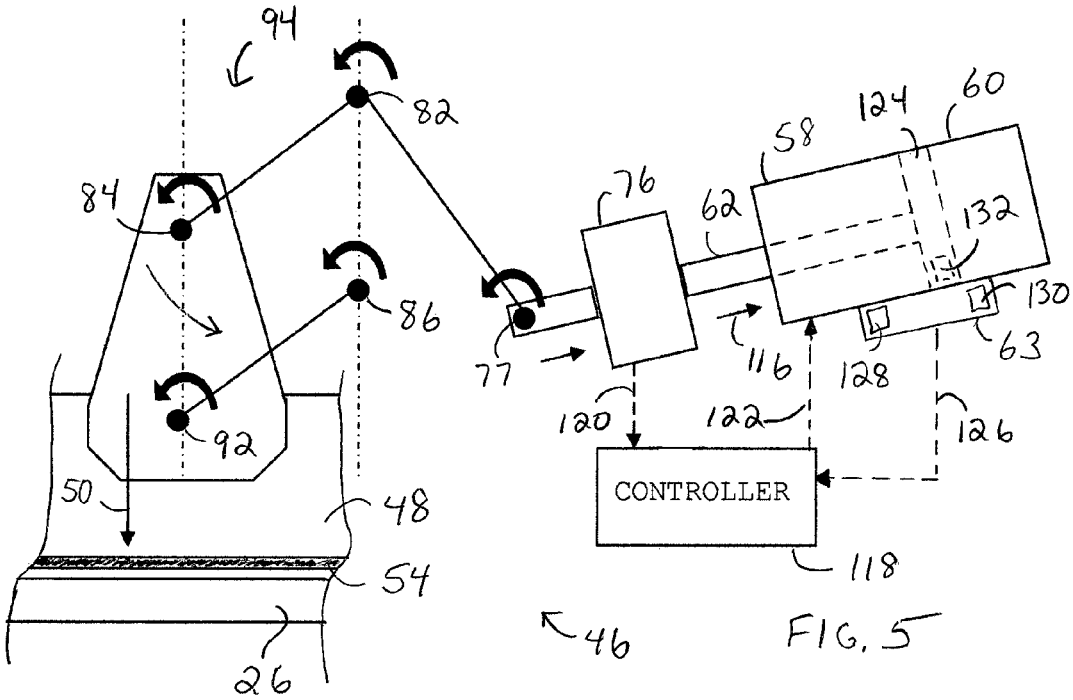
FIG. 5 shows a block diagram of the system of FIG. 2 exemplifying a downward vertical movement of an end effector in response to actuation of a linear actuator.

Referring to FIGS. 4-5, FIG. 4 shows a block diagram of adjustment system 46 exemplifying upward vertical movement 50 of end effector 48 in response to actuation of linear actuator 58. FIG. 5 shows a block diagram of adjustment system 46 exemplifying downward vertical movement 50 of end effector 48 in response to actuation of linear actuator 58. The operation of first linkage assembly 94 is described in connection with FIGS. 4 and 5, for simplicity of illustration. However, it should be understood that the following description applies equally to second linkage assembly 96 (FIG. 3).

As mentioned previously, adjustment system 46 enables precise movement of end effector 48 relative to polishing pad 26 in the presence or absence of a gimbal mechanism. In addition, adjustment system 46 maintains abrasive disk 54 parallel with polishing pad 26 through vertical movement 50 of end effector 48.

As shown in FIGS. 4 and 5, linear actuator 58 is oriented approximately horizontally. By arranging linear actuator 58 approximately horizontally, the vertical height of adjustment system 46 is advantageously minimized. Accordingly, drive element 62 imparts linear force 116 in an approximately horizontal direction. Linear force 116 is therefore referred to as horizontal force 116 hereinafter.

As further shown in FIGS. 4 and 5, adjustment system 46 further includes a controller 118 in electrical communication with each of force transducer 76, linear actuator 58, and position sensor 63. More specifically, controller 118 is capable of receiving a force signal 120 corresponding to horizontal force measured by force transducer 76. Controller 118 is further capable of communicating an actuation signal 122 to adjust an actuation of drive element 62 of linear actuator 58 in response to the received force signal 120. In an exemplary embodiment, actuation signal 122 controls movement of a piston 124 internal to linear actuator 58 and coupled with drive element 62.

Force signal 120 is advantageously utilized to control the conditioning pressure of abrasive disk 54.

Pressure is a function of the force applied to a unit area of surface. In this instance, conditioning pressure is thus a function of the applied force of abrasive disk 54 relative to the surface area of abrasive disk 54 as follows:

$$\text{Conditioning pressure} = \text{applied force}/\text{surface area}$$

If a desired conditioning pressure is 1 psi (pounds per square inch), and the surface area of abrasive disk is 12.6 $in^2$, then the applied force is as follows:

$$\text{Applied force} = 1\ \text{psi} \times 12.6\ in^2 = 12.6\ \text{lbs}$$

In continuing the above example, the weight of abrasive disk 54 and end effector 48 may be approximately 2 pounds. Thus, horizontal force 116 generated by linear actuator 58 is as follows:

Horizontal force=applied force−weight=12.6−2=10.6 lbs

Assuming negligible friction, when the desired conditioning pressure is applied, force signal 120 should be equivalent to 10.6 lbs. As known to those skilled in the art, force transducer 76 provides force signal 120 as a voltage. If the force signal output of force transducer 76 is 100 lbs, 5 V full scale, then the force transducer scale factor is 20 pounds per volt. Hence, force signal 120 for a generated force is as follows:

Force signal=generated force/scale factor=10.6/20=0.53V

Consequently, to obtain the desired conditioning pressure of 1 psi, actuation signal 122 is adjusted by controller 148 to maintain force signal 120 at 0.53 V, thereby maintaining horizontal force 116 at 10.6 lbs.

As mentioned above, controller 118 is in electrical communication with position sensor 63 to receive a position signal 126 indicating a position of end effector 48. In an exemplary scenario, position sensor 63 may include a first reed switch 128 and a second reed switch 130. A magnet 132 is mounted on piston 124. Each of first and second reed switches 128 and 130, respectively, can sense magnet 132 when piston 124 moves in proximity to either of switches 128 and 130. In an exemplary embodiment, first reed switch 128 is positioned to detect an extension of drive element 62 (shown in FIG. 4) so that end effector 48 is in an up position. Similarly, second reed switch 130 is positioned to detect a retraction of drive element 62 (shown in FIG. 5) so that end effector 48 is in a down position.

First and second reed switches 128 and 130 are useful to verify the actual position of end effector 48, and consequently abrasive pad 54, which is important for controlling machine timing and for detecting errors due to component failure or other causes. Although only two reed switches are shown, it should be understood that other switches could be added to sense other desired intermediate positions. Reed switches are preferred because they are immune to dust and moisture. In addition, reed switches are passive devices that have the advantage of using no power, and having no leakage current across the contacts. However, position sensing of the present invention is not limited to the use of reed switches. Rather, other position sensors, such as continuous position feedback switches, magnetostrictive position sensors, Hall effect sensors, or any of a variety of sensors for providing information concerning the position of end effector 48 may alternatively be utilized.

Referring first to FIG. 4, when drive element 62 is extended, the imparted horizontal force 116 pushes against first segment 68 of first link member 62 at actuator pivot point 77. Due to the pivotal attachment of first and second link members 62 and 66 to each of conditioning arm 52 and end effector 48, first and second link members 62 and 66 pivot in response to horizontal force 116. This pivoting action produces vertical movement 50 of end effector 48 in an upward direction and away from polishing pad 26.

Referring to FIG. 5, when drive element 62 is retracted, the imparted horizontal force 116 pulls first segment 68 of first link member 62 at actuator pivot point 77. Due to the pivotal attachment of first and second link members 62 and 66 to each of conditioning arm 52 and end effector 48, first and second link members 62 and 66 pivot in the opposite direction relative to FIG. 4 in response to horizontal force 116. This opposite pivoting action produces vertical movement 50 of end effector 48 in a downward direction and toward polishing pad 26.

Horizontal force 116 imparted at first segment 68 is translated through first and second link members 64 and 66, respectively, to produce vertical movement 50. However, in either condition, end effector 48 follows an arc of travel, as represented by an arrow 134 in each of FIGS. 4 and 5. The parallel arrangement of second segment 70 and second link 66, and pivot capability of first linkage assembly 94, advantageously cause abrasive pad 54 of end effector 48 to remain parallel to polishing pad 26 despite the arc of travel 134. This parallel arrangement yields effective, uniform conditioning.

Figure 6:
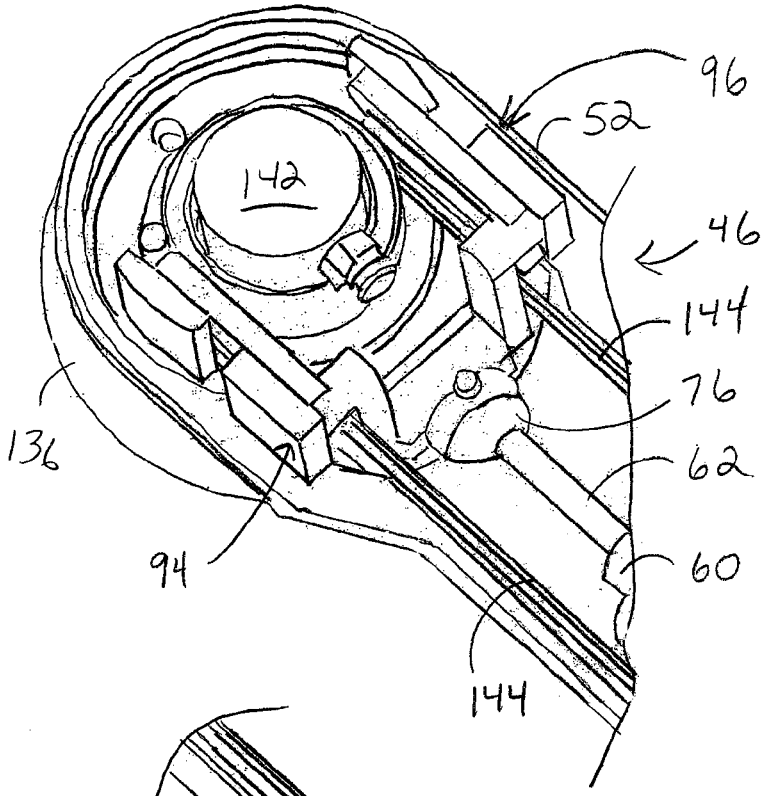
FIG. 6 shows a partial top perspective view of the adjustment system of FIG. 2 interconnected with a first end of a conditioning arm of the conditioning apparatus.
Figure 7:
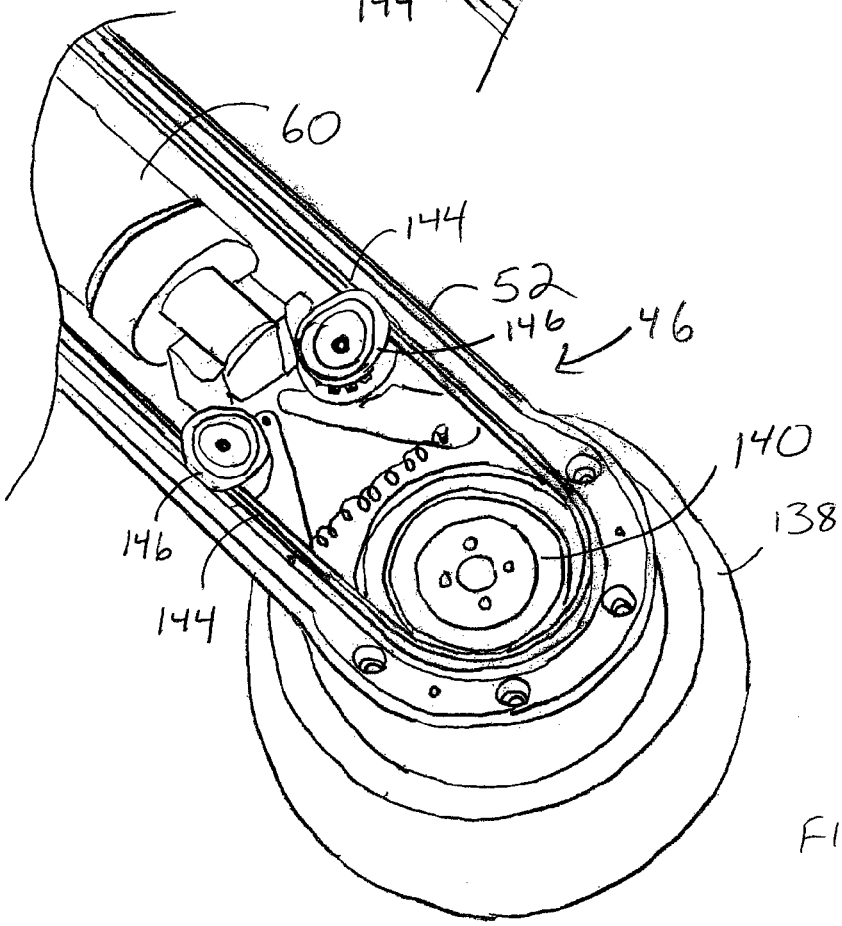
FIG. 7 shows a partial top perspective view of the system of FIG. 2 interconnected with a second end of a conditioning arm of the conditioning apparatus.
Figure 8:
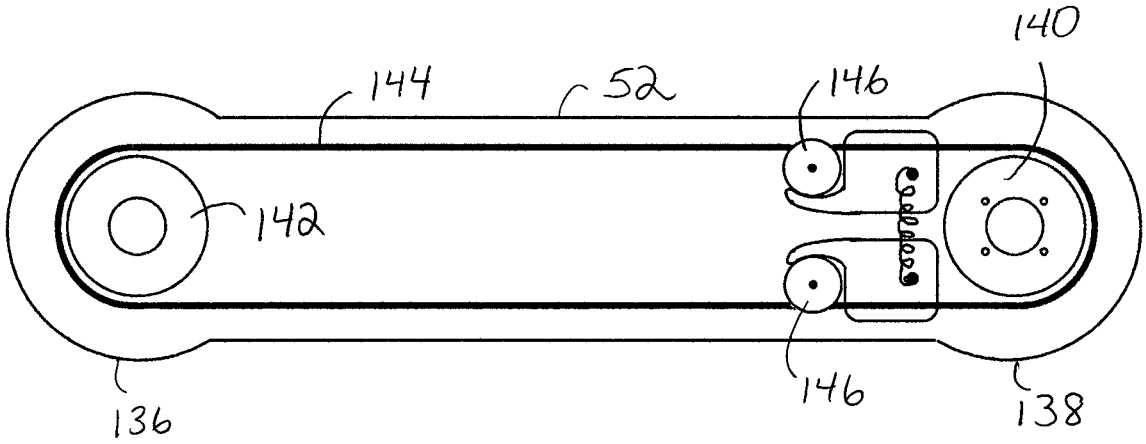
FIG. 8 shows a simplified top view of the conditioning arm of the conditioning apparatus.

Referring to FIGS. 6-8, FIG. 6 shows a partial top perspective view of adjustment system 46 interconnected with a first end 136 of conditioning arm 52. FIG. 7 shows a partial top perspective view of adjustment system 46 interconnected with a second end 138 of conditioning arm 52, and FIG. 8 shows a simplified top view of conditioning arm 52.

End effector 48 (FIG. 2) is a belt driven system. More specifically, a driving gear 140 of drive mechanism 56 is interconnected with a driven gear 142 of end effector 48 via an endless belt 144. When driving gear 140 is rotated by drive mechanism 56, this rotation is transferred to driven gear 142 through belt 144. The rotation of driven gear 142 causes commensurate rotation of end effector 48. In order to operate effectively, the tension in belt 144 should stay constant. Although the total vertical travel of end effector 48 may only be approximately 0.5 inch, as end effector follows arc of travel 134, the tension in belt 144 could decrease, resulting in slack in belt 144.

To counter this problem, adjustment system 46 further includes means for maintaining tension in belt 144 as end effector 48 is adjusted. In a preferred embodiment, means for maintaining tension in belt 144 includes idler pulleys 146. Idler pulleys 146 are spring-loaded pulleys mounted on shafts and designed to press against belt 144 to maintain the tension of belt 144 as end effector 48 follows arc of travel 134. Those skilled in the art will recognize that other techniques may alternatively be employed for maintaining the tension in belt 144 as end effector 48 follows arc of travel 134.

In summary, the present invention teaches of an adjustment system for adjusting an end effector of a conditioning apparatus relative to a polishing pad. The adjustment system includes a parallel linkage assembly that is actuated by a linear actuator to move the end effector vertically. The linear actuator is arranged approximately horizontally to minimize vertical height of the system. The horizontal linear force provided by the linear actuator is translated through the parallel linkage assembly to yield vertical movement of the end effector. A force transducer is interposed between the linear actuator and the linkage assembly and measures applied force so that the conditioning pressure can be precisely controlled. In addition, a position sensor is provided for detecting the position of the end effector relative to the polishing pad.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A system for adjusting an end effector of an apparatus relative to a workpiece comprising:

a linear actuator configured for fixed attachment with an arm of said apparatus;

a first link member including a first segment and a second segment adjoined with said first segment, said second segment being arranged approximately perpendicular to said first segment, said first segment being operatively coupled with said linear actuator; and a second link member maintained in parallel alignment with said second segment, said second segment and said second link member being configured for pivotal attachment with said end effector, wherein movement of said first segment powered by said linear actuator causes said first and second link members to pivot producing movement of said end effector relative to said workpiece.

2. A system as claimed in claim 1 wherein said linear actuator comprises a drive element arranged to impart an approximately horizontal force at said first segment, said horizontal force being translated through said first and second link members to produce approximately vertical movement of said end effector.

3. A system as claimed in claim 1 wherein said linear actuator is a double acting linear actuator that includes a drive element in operative communication with said first segment.

4. A system as claimed in claim 1 wherein:

said first link comprises a first pivot point configured for pivotal attachment to said arm; and said second link comprises a second pivot point configured for pivotal attachment to said arm.

5. A system as claimed in claim 4 wherein said first and second pivot points are configured for vertical alignment on said arm.

6. A system for adjusting an end effector of an apparatus relative to a workpiece comprising:

a linear actuator configured for fixed attachment with an arm of said apparatus;

a first link member including a first segment and a second segment adjoined with said first segment, said first segment being operatively coupled with said linear actuator, said first link member further including a first pivot point located at a junction of said first and second segments and configured for pivotal attachment to said arm; and a second link member maintained in parallel alignment with said second segment, said second segment and said second link member being configured for pivotal attachment with said end effector, said second link member including a second pivot point configured for pivotal attachment to said arm, wherein movement of said first segment powered by said linear actuator causes said first and second link members to pivot producing movement of said end effector relative to said workpiece.

7. A system as claimed in claim 4 wherein said second link comprises a first end and a second end, said second pivot point is located at said first end, and said second link includes an effector pivot point located at said second end, said effector pivot point being configured for pivotal attachment with said end effector.

8. A system as claimed in claim 1 wherein:

said first segment comprises a first end and a second end, said first segment being operatively coupled with said linear actuator at said first end; and said second segment comprises a third end and a fourth end, said third end being adjoined with said second end of said first segment, and said fourth end includes an effector pivot point configured for pivotal attachment with said end effector.

9. A system as claimed in claim 1 wherein:

said second segment of said first link includes a first effector pivot point configured for pivotal attachment with said end effector; and said second link includes a second effector pivot point configured for pivotal attachment with said end effector, said first and second effector pivot points being configured for vertical alignment on said end effector.

10. A system as claimed in claim 1 wherein said first and second link members form a first linkage assembly, and said system further comprises a second linkage assembly adapted to be positioned on an opposing diametrical side of said end effector relative to said first linkage assembly, said second linkage assembly comprising:

a third link member including a third segment and a fourth segment adjoined with said third segment, said third segment being operatively coupled with said linear actuator; and a fourth link member maintained in parallel alignment with said fourth segment, and said fourth segment and said fourth link member being configured for pivotal attachment with said end effector.

11. A system as claimed in claim 1 further comprising a force transducer interposed between said linear actuator and said first segment of said first link.

12. A system as claimed in claim 11 further comprising a controller in electrical communication with said force transducer and said linear actuator, said controller receiving a force signal measured by said force transducer and adjusting an actuation of said linear actuator in response to said received force signal.

13. A system as claimed in claim 1 further comprising a position sensor in communication with said linear actuator for indicating a position of said end effector.

14. A system as claimed in claim 1 wherein said apparatus includes a drive mechanism for imparting rotary motion to said end effector, said end effector is driven by said drive mechanism via a timing belt, and said system further comprises means for maintaining tension of said timing belt as said end effector is adjusted.

15. A system for adjusting an end effector of an apparatus relative to a workpiece comprising:

a linear actuator configured for fixed attachment with an arm of said apparatus, said linear actuator including a drive element arranged to impart an approximately horizontal force;

a first link member including a first segment and a second segment adjoined with said first segment, said second segment being arranged approximately perpendicular to said first segment, said first segment being operatively coupled with said drive element, and said first link member including a first pivot point positioned at a junction of said first and second segments and configured for pivotal attachment to said arm; and a second link member maintained in parallel alignment with said second segment and including a second pivot point configured for pivotal attachment to said arm, said second segment and said second link member being further configured for pivotal attachment with said end effector, wherein movement of said first segment powered by said approximately horizontal force of said drive element causes said first and second link members to pivot producing approximately vertical movement of said end effector relative to said workpiece.

16. A system as claimed in claim 15 wherein said first and second pivot points are configured for vertical alignment on said arm.

17. A system as claimed in claim 16 wherein:

said second segment of said first link includes a first effector pivot point configured for pivotal attachment with said end effector; and said second link includes a second effector pivot point configured for pivotal attachment with said end effector, said first and second effector pivot points being configured for vertical alignment on said end effector.

* * * * *